US009078514B2

(12) United States Patent
Nalbandian

(10) Patent No.: US 9,078,514 B2
(45) Date of Patent: Jul. 14, 2015

(54) BRUSH CAP FOR CLEANING

(71) Applicant: Raffi Nalbandian, Toronto (CA)

(72) Inventor: Raffi Nalbandian, Toronto (CA)

( * ) Notice: Subject to any disclaimer, the term of this patent is extended or adjusted under 35 U.S.C. 154(b) by 0 days.

(21) Appl. No.: 14/019,878

(22) Filed: Sep. 6, 2013

(65) Prior Publication Data

US 2014/0072361 A1 Mar. 13, 2014

Related U.S. Application Data

(60) Provisional application No. 61/697,840, filed on Sep. 7, 2012.

(51) Int. Cl.
*A46B 11/00* (2006.01)
*A46B 9/02* (2006.01)

(52) U.S. Cl.
CPC ..... *A46B 11/0072* (2013.01); *A46B 9/02* (2013.01); *A46B 11/0017* (2013.01); *A46B 11/0089* (2013.01); *A46B 2200/306* (2013.01)

(58) Field of Classification Search
CPC ..... A46B 3/00; A46B 3/22; A46B 9/02; A46B 9/028; A46B 9/08; A46B 9/12; A46B 11/0089; A46B 11/06; A46B 11/0017; A46B 17/04; B64D 83/285
USPC ..... 401/190, 119, 123, 124, 126, 129, 269, 401/268
See application file for complete search history.

(56) References Cited

U.S. PATENT DOCUMENTS

| | | | | | |
|---|---|---|---|---|---|
| 1,855,572 | A * | 4/1932 | Gabriel | 401/166 |
| 3,137,885 | A * | 6/1964 | Hulsh | 401/190 |
| 3,370,908 | A * | 2/1968 | Cupp | 401/190 |
| 4,717,278 | A * | 1/1988 | Kemeny | 401/286 |
| 4,735,319 | A | 4/1988 | Mead | |
| 4,848,946 | A * | 7/1989 | Goncalves | 401/131 |
| 5,007,754 | A * | 4/1991 | Zierhut | 401/174 |
| 5,066,157 | A | 11/1991 | Liff | |
| 5,188,472 | A | 2/1993 | Sgro | |
| 5,213,430 | A | 5/1993 | Pandola | |
| 5,446,939 | A | 9/1995 | Park | |
| 5,899,623 | A * | 5/1999 | de Laforcade | 401/190 |
| 6,036,389 | A | 3/2000 | Zima | |
| 6,311,357 | B1 | 11/2001 | Horian | |
| 6,457,894 | B1 | 10/2002 | Miles | |
| 6,598,256 | B2 * | 7/2003 | Theriault | 15/104.92 |
| 6,789,970 | B1 | 9/2004 | Shearon et al. | |
| D510,863 | S | 10/2005 | Juhng et al. | |
| 7,309,185 | B2 * | 12/2007 | Thorpe et al. | 401/277 |
| D608,097 | S | 1/2010 | Zanjani et al. | |
| 8,475,070 | B1 * | 7/2013 | Miner et al. | 401/190 |

* cited by examiner

*Primary Examiner* — David Walczak
(74) *Attorney, Agent, or Firm* — Fay Sharpe LLP; James E. Scarbrough

(57) ABSTRACT

A brush cap assembly for cleaning has a first cylindrical portion, a second portion having an inclined surface extending from the first portion, a plurality of holes formed in the inclined surface, and a plurality of bristles extending from the inclined surface.

11 Claims, 4 Drawing Sheets

BRUSH CAP FOR CLEANING

CLAIM OF PRIORITY

This application claims priority from provisional patent application Ser. No. 61/697,840, filed on Sep. 7, 2012, which is hereby incorporated by reference in its entirety.

BACKGROUND OF THE DISCLOSURE

The present disclosure relates generally to a cleaning brush, and more particularly to a cleaning brush and cap wherein the brush has bristles integrated into the cap of an aerosol can preferably containing cleaning chemicals such as shoe cleaner or other cleaners.

There are many cleaning devices available for a variety of products and applications. For example, for shoes, there are brushes and cloths that are made to meet the needs of individuals who want a quick shoe cleaning by providing a personalized shoe cleaning kit which comes with brush, shoe cleaner, and a cloth. These kits are relatively cumbersome and result in a messy operation to obtain a quick shoe cleaning. Furthermore, there are several separate items needed for the kit, such as a brush, shoe cleaner or other cleaner, a cloth, a storage container, etc.

Thus, there is a need to simplify the process of shoe cleaning by virtue of consolidating conventional shoe cleaning components such as a brush applicator and the aerosol can into a convenient compact single container. A brush integrated into an aerosol can cap simplifies the usage of the brush and cleaner and provides a new and improved method of personal shoe cleaning. The brush and cap are not limited to shoe cleaning and may be used with other cleaning solutions and applications as well, such as car upholstery, leather, furniture carpet, fabric, draperies, etc.

SUMMARY OF THE DISCLOSURE

In accordance with one aspect of the disclosure, a brush cap assembly for cleaning has a first body, an inclined surface extending from the first body, a plurality of holes formed in the surface, and a plurality of bristles entering from the inclined surface.

Another aspect of this disclosure is to remedy the cumbersome and messy operation in obtaining a quick cleaning such as shoe cleaning by providing an aerosol can with an integrated brush and cap.

Another aspect of the disclosure is the brush is integrated into the shape of a cylindrical cap.

Another aspect of the disclosure is a separate lid is placed over the brush cap to provide an air tight seal for the brush cap and aerosol can. The cylindrical body of the cap has a flat angled top and angled bristles on the cap. The bristles on the top portion of the cylindrical body of the cap are designed to be used as a cleaner applicator to the article being cleaner, such as shoes, upholster, etc. Also provided is a top lid to fit over the brush on the top of the can.

It is a further aspect of the present disclosure to provide a portable and easy to use cleaning brush cap with an aerosol can.

It is also an aspect of the disclosure to provide a brush with soft bristles for cleaning shoes, leather, upholstery, etc. It is a further object of the disclosure to provide angled or tapered bristles to facilitate thorough and easier cleaning.

Other aspects of the disclosure will become apparent upon a reading and understanding of the following detailed description.

DETAILED DESCRIPTION OF THE DISCLOSURE

Now referring to FIG. 1-FIG. 7B, a cylindrical brush cap A in accordance with the preferred embodiment of the disclosure is shown.

Figure 1:
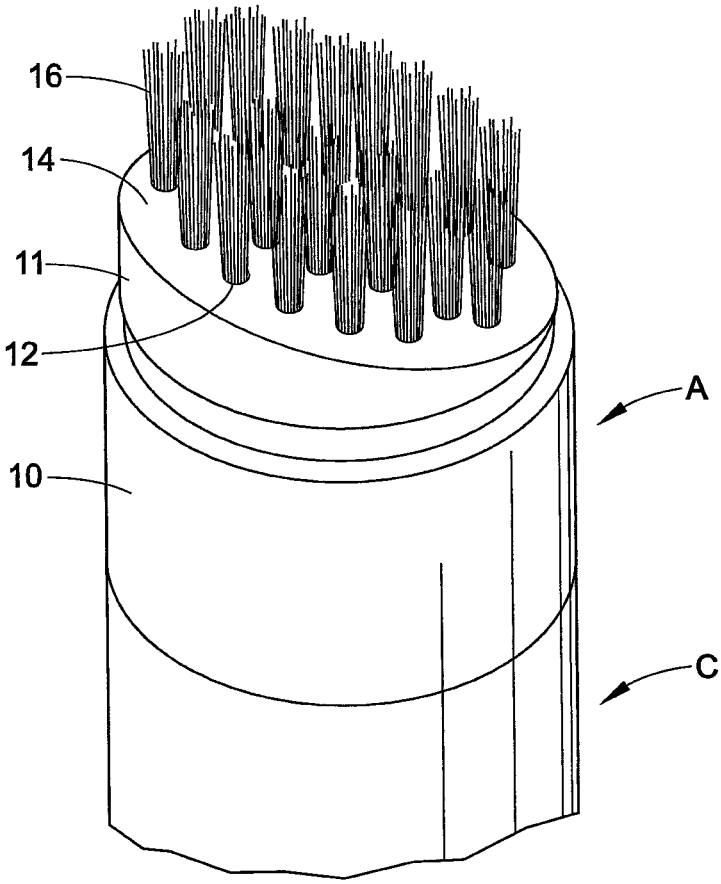
FIG. 1 is a perspective view of the brush cap in accordance with a preferred embodiment of the disclosure.
Figure 2:
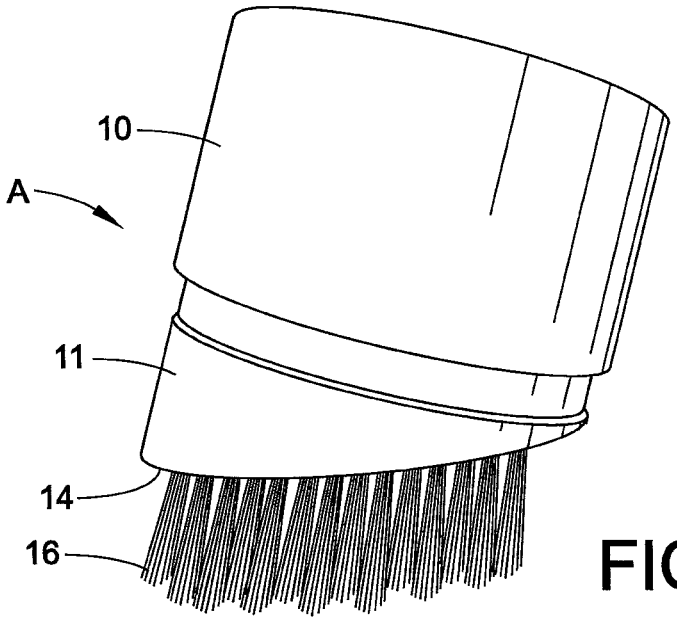
FIG. 2 is a side elevational view of the brush cap of FIG. 1.

Referring to FIGS. 1 and 2, there is shown in accordance with a preferred embodiment of the disclosure a cylindrical brush cap A positioned on an upper surface of an aerosol can C. Brush cap A has a first portion forming a cylindrical wall 10, a second tapered or angled portion 11 extending from portion 10, and round or circular bristle openings 12 formed on a top angled surface 14 of portion 11 onto which a plurality of clusters of bristles 16 are placed to extend outwardly. The bristles are shown in FIG. 5B as forming cylindrical groups of bristles, but square or other shapes are contemplated by the disclosure as well. The bristles 16 are inserted into cap round openings 12 and extend upwardly and outwardly. The cylindrical brush cap is preferably made of rigid plastic but other materials can be used as well. The angled top wall 14 can be at a variety of angles B with respect to horizontal (i.e., 20°, 30°, 45°, etc.).

Figure 4:
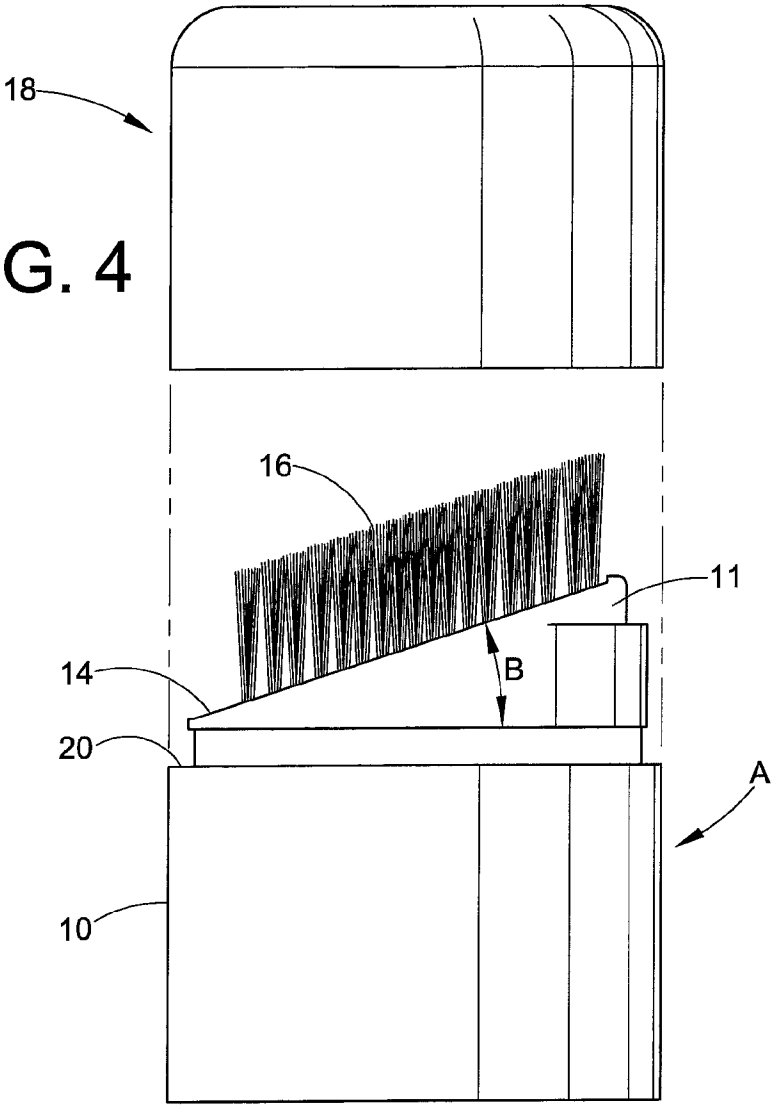
FIG. 4 is a side elevational view of the brush cap and lid in an opened configuration.
Figure 3:
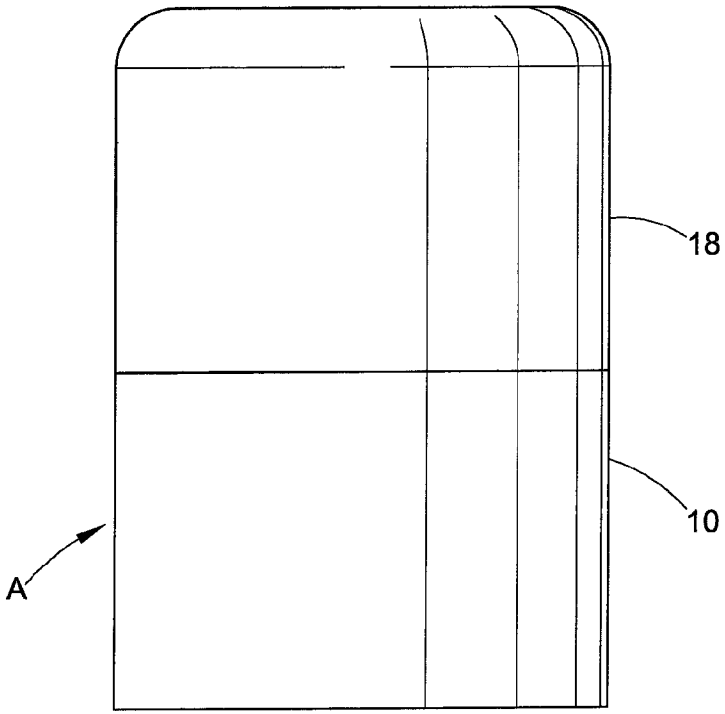
FIG. 3 is a side elevational view of a brush cap and lid in accordance with the preferred embodiment of the disclosure.

FIGS. 3 and 4 illustrate a cylindrical cleaning brush cap A with a second body or mating cylindrical covering lid 18 at a lowered or closed position over the top bristles 16 in FIG. 3 and a raised or open position over the top bristles 16 in FIG. 4. The lid 18 can be snapped into or onto the upper surface 20 of the brush cap or secured to the brush cap 10 by other suitable retaining means. The lid provides an air tight seal for the brush cap and the aerosol can.

The brush cap itself is secured to an upper end of an aerosol can by threading the cap onto the can or by other suitable retaining means. For example, an advantage of the brush is it can be attached to aerosol cans such as manufactured by DS Containers Inc. of Batavia, Ill. Presently, there are no brushes known to be designed to accommodate these cans. The aerosol can preferably contains chemicals for use as a shoe cleaner, a carpet cleaner, a fabric or drapery cleaner, a car upholstery cleaner, or any other suitable cleaning use.

Referring now to FIGS. 5A-7B, more detailed views of the brush cap A and lid 18 are shown. Dimensions are shown for example only and can vary without departing from the scope of the disclosure.

Figure 5A:
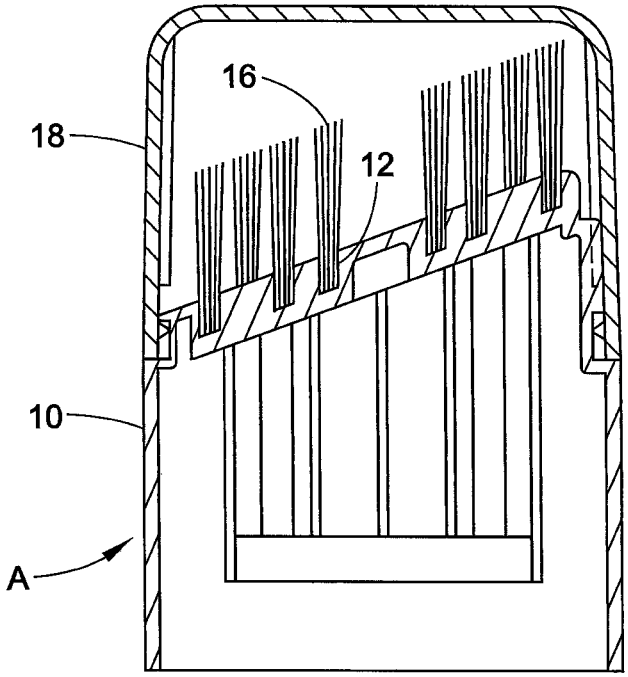
FIG. 5A is a side elevational view in cross-section of the brush cap and lid in a closed configuration.
Figure 5B:
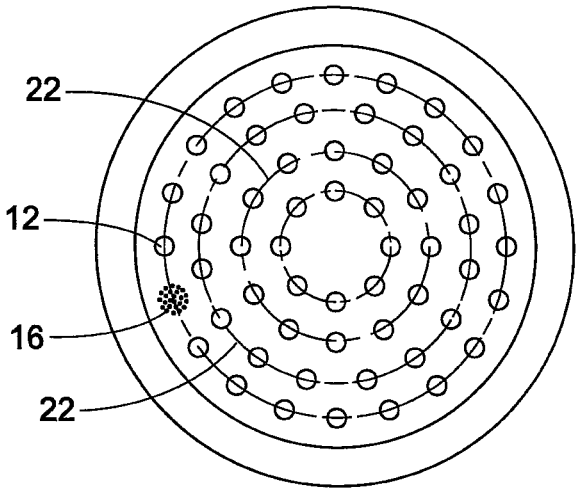
FIG. 5B is a to plan view of the brush cap.

Referring now to FIGS. 5A and 5B, a cross-sectional and top plan view of the brush cap are shown. Bristles 16 are formed and inserted into openings 12 in upper surface 14. The uniqueness and advantages of the brush is that the bristles are made of a soft nylon material. Typically bristles of cleaning brushes are made of hard nylon bristles which could damage the surface of the material being cleaned (e.g., shoe leather, upholstery, etc.). The bristles are positioned and formed along concentric circles 22 shown in FIG. 5B. The number of concentric circles and the number of bristles in each circle can vary without departing from the scope of the disclosure.

Figure 6A:
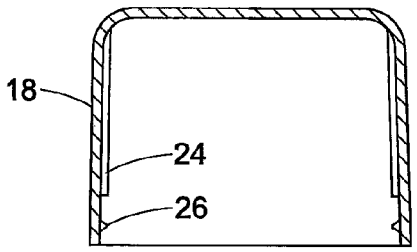
FIG. 6A is a side elevational view of the lid.
Figure 6B:
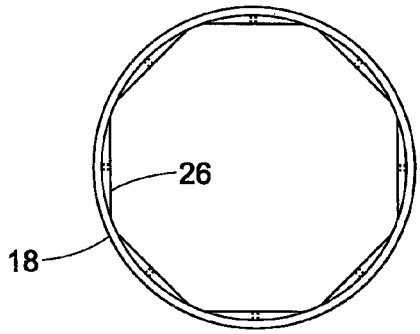
FIG. 6B is a top plan view of the lid.

Referring to FIGS. 6A and 6B, the lid 18 is shown in more detail. The lid has an internal ledge or cutout 24 with a rib or nub or protrusion 26 extending therefrom which engages an outer indented edge 28 (FIG. 7A) of portion 11 of the brush cap to serve as a retaining means for securing the lid to the cap.

Figure 7A:
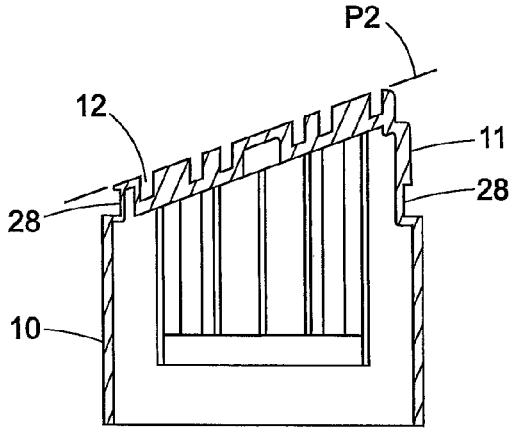
FIG. 7A is a side elevational view of the brush cap without bristles and the bristles removed.
Figure 8:
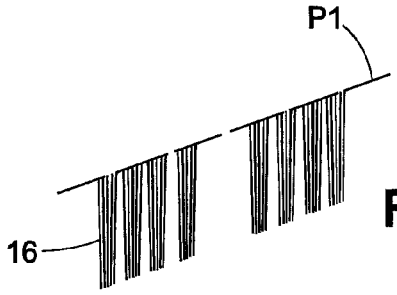
FIG. 8 is a side elevational view of the bristles removed from the brush cap of FIG. 7A and FIG. 7B.
Figure 7B:
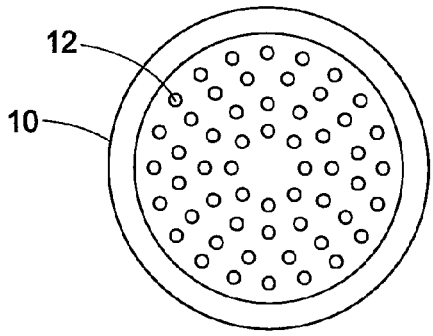
FIG. 7B is a top plan view of the brush cap.

FIGS. 7A and 7B illustrate the brush cap A with the bristles 16 removed. The removed bristles are shown in FIG. 8. The openings 12 for receiving the bristles 16 are clearly shown. The openings 12 can vary in spacing and length. The bristles are proportioned such that the top portion of the of the bristles form a plane P1 (FIG. 7B) which is substantially parallel to the plane P2 (FIG. 7A) of the angled top surface 14 of the brush cap. However, the bristles do not have to be parallel to upper surface 14.

The angled configuration of the bristles provides the advantage of easier polishing and applying cleaner to a shoe or other article as well as buffing the shoe or article to be cleaned. Typically, shoe cleaning brushes do not have an angle or taper to them.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A brush cap assembly and aerosol can for cleaning, comprising:

a brush cap comprising:

a first body having:

a first cylindrical portion;

a second portion extending from said first cylindrical portion and having an inclined surface having a first end adjacent a first end of said first cylindrical portion and a second end adjacent a second end of said first cylindrical portion wherein said second end of said inclined surface is at an angle to said first end of said first cylindrical portion;

a plurality of holes formed in said inclined surface wherein said inclined surface extends between said first and second ends of said first cylindrical portion;

a plurality of bristles within said holes and extending from said inclined surface; said bristles extend substantially parallel to an outer longitudinal wall of said first body; and, a second body which matingly engages said first body, wherein a protrusion formed on said second body engages an edge formed below said inclined surface on opposite sides of said inclined surface wherein said edge is not parallel to said inclined surface;

wherein said second body has a wall which aligns in a substantially parallel manner with a longitudinal wall of said first body when said second body engages said first body; and an aerosol can wherein said first body and second body are secured to an upper surface of said aerosol can.

2. The brush cap assembly of claim 1, wherein said first portion is cylindrical.

3. The brush cap assembly of claim 1, wherein said bristles form a plane at outer ends of said bristles which is substantially parallel to a plane formed by said inclined surface.

4. The brush cap assembly of claim 3, wherein said inclined surface has an angle of about 30 degrees with respect to a horizontal plane.

5. The brush cap assembly of claim 4, wherein said bristles have outer ends forming an angle of about 30 degrees with a horizontal plane.

6. The brush cap assembly of claim 1, wherein said bristles form cylindrical groups of bristles.

7. The brush cap assembly of claim 1, wherein said first body is fabricated from plastic.

8. The brush cap assembly of claim 1, wherein said bristles are formed from soft nylon.

9. The brush cap assembly of claim 1, wherein said second body is cylindrical.

10. The brush cap assembly of claim 1, wherein said holes are formed along concentric circles.

11. The brush cap assembly of claim 1, wherein said second body forms a lid.

* * * * *